United States Patent [19]

Kessler

[11] Patent Number: 4,717,152

[45] Date of Patent: Jan. 5, 1988

[54] RACKET GRIP

[76] Inventor: Fred B. Kessler, 12 Shadow Lawn, Houston, Tex. 77005

[21] Appl. No.: 836,422

[22] Filed: Mar. 5, 1986

[51] Int. Cl.[4] ..... A63B 49/08

[52] U.S. Cl. ..... 273/75

[58] Field of Search ..... 273/67 R, 73 R, 73 J, 273/75, 76, 67 D, 67 DA, 67 DB, 29 A; 621/222

[56] References Cited

U.S. PATENT DOCUMENTS

| | | | |
|---|---|---|---|
| 4,101,125 | 7/1978 | Heath | 273/73 J |
| 4,282,642 | 8/1981 | Rodgers, Jr. | 273/73 J X |
| 4,349,199 | 9/1982 | Vulcano | 273/75 |
| 4,374,589 | 2/1983 | Strickland | 273/75 |
| 4,505,480 | 3/1985 | Vanhoutte | 273/73 J |
| 4,565,371 | 1/1986 | Pawlicki et al. | 273/73 J |

FOREIGN PATENT DOCUMENTS

| | | | |
|---|---|---|---|
| 2232337 | 1/1975 | France | 273/75 |
| 2407725 | 7/1979 | France | 273/76 |
| 17012 | 11/1928 | United Kingdom | 273/75 |

*Primary Examiner*—Richard C. Pinkham
*Assistant Examiner*—Matthew L. Schneider
*Attorney, Agent, or Firm*—Bernard A. Reiter; Mark G. Bocchetti

[57] ABSTRACT

Disclosed is an improved grip for tennis rackets. The grip is inversely tapered such that it narrows moving along the axis of the handle away from the head of the racket. Further, the grip is hexagonal in cross-section. In other words, the grip is substantially a truncated hexagonal pyramid. This design is structurally compatible with the skeletal and muscular structure of the human hand, wrist and arm. The inverse taper allows for more comfortable gripping by allowing the wrist to automatically go into dorsi flexion which results in permitting the fingers to flex more easily. The mobile ring and little finger metacarpals are allowed to oppose the thenar emminence thus bringing the ring and little fingers into more advantageous contact with the grip thereby making the holding of the grip less fatiguing. Further, the hexagonal shape allows much more desirable points of contact between the palmar surfaces of the distal, middle and proximal phalanges of the index finger as well as the palmar surface of the metacarpals of the thumb and index finger with the surfaces of the grip. The grip of the present invention is not only more comfortably and less fatiguing, but also allows for greater control of the racket. Further, use of a racket with the grip of the present invention will aide in preventing tennis injuries such as tennis elbow.

5 Claims, 4 Drawing Figures

RACKET GRIP

BACKGROUND OF THE INVENTION

1. Field of the Invention

This invention relates generally to grips for tennis rackets and more particularly, to tapered, hexagonally shaped tennis racket grips.

2. Brief Description of the Prior Art

The conventional tennis racket grips found in the prior art are generally octagonal in shape. The dimensions of the octagonal cross-section increase toward the base of the grip. In other words, that portion of the grip having the greatest dimensions is the extreme end of the grip away from the head of the racket.

French Demande De Brevet D'Invention No. 73 20488 apparently teaches an octagonally shaped tennis racket grip which narrows toward the butt end but ultimately flares to a greater dimension at the base of the grip. The purpose of the flared end is not apparent but the flared end itself would be self defeating of the purpose of designing a tennis racket grip which more closely approaches the needs defined by the structure of the human hand. Further, the octagonal shape demonstrated in conventional tennis rackets as well as that shown in the French document is contradictory to the structural structure of the human hand. The French design has yet another deficiency. By tapering the handle, a significant amount of mass is removed from the racket which ultimately relocates the center of gravity of the racket causing the racket to become unbalanced.

SUMMARY OF THE INVENTION

It is therefore an object of the present invention to provide an inverse tapered tennis racket grip for optimum skeletal and muscular compatability.

It is a further object of the present invention to provide an improved tennis racket grip having a hexagonally shaped cross-section to be more structurally compatible with the human hand.

Yet another object of the present invention is to provide an improved tennis racket grip having an inverse tapered handle where a weight is added to the handle to maintain a proper center of gravity.

A further object of the present invention is to provide an improved tennis racket grip which allows the wrist to comfortably go into dorsi flexion thereby allowing the fingers to flex more comfortably with less fatigue about the grip.

Briefly stated, the foregoing and numerous other objects and advantages of the present invention are accomplished by tapering the grip of tennis rackets such that the extreme or butt end of the handle is dimensionally the smallest portion of the grip. Tapering the grip in such manner achieves a structural compatibility with the holding capacity of the human hand.

Further, the grip of the present invention has a hexagonal cross-section as opposed to an octagonal cross-section. This hexagonal shape is an additional improvement to structural compatibility between the human hand and the tennis racket grip. When the human hand is partially closed such that the tip of the thumb is abutting or in close proximity to the tip of the index finger, the shape formed therebetween more closely approximates a hexagon then an octagon.

By tapering the grip of a tennis racket and making such grip hexagonal in shape, the center of gravity of a particular racket can be significantly effected. This relocation of the center of gravity of the tennis racket can be most undesirable in that the racket becomes unbalanced. To correct this problem, it will be necessary to add weight to the handle to maintain the proper center of gravity. This can be accomplished by a variety of methods including the drilling of a hole in the base of the handle for insertion of a denser piece of material such as lead.

The net result of these modifications to a tennis racket grip is a tennis racket which is significantly more compatible with the structure of the human hand and therefore, alleviates many of the muscle and tendon problems associated with tennis such as that injury which is typically referred to as tennis elbow.

DESCRIPTION OF THE PREFERRED EMBODIMENT

Figure 1:
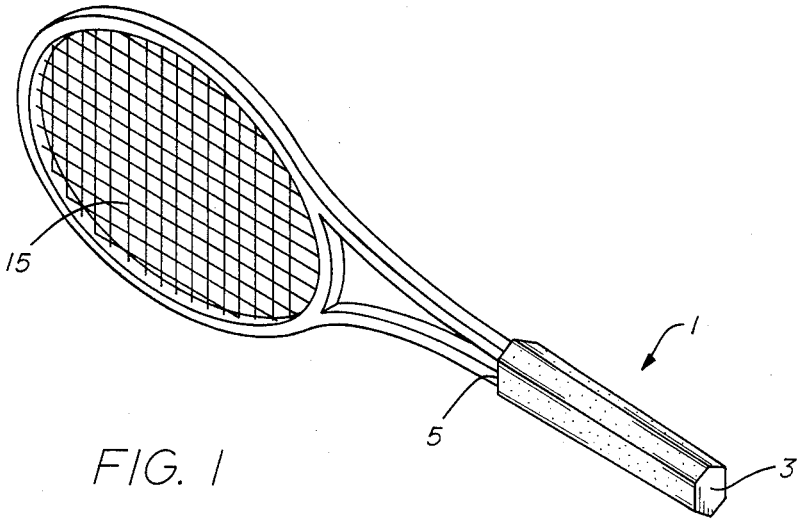
FIG. 1 is an isometric view of a tennis racket with the grip of the present invention.
Figure 2:
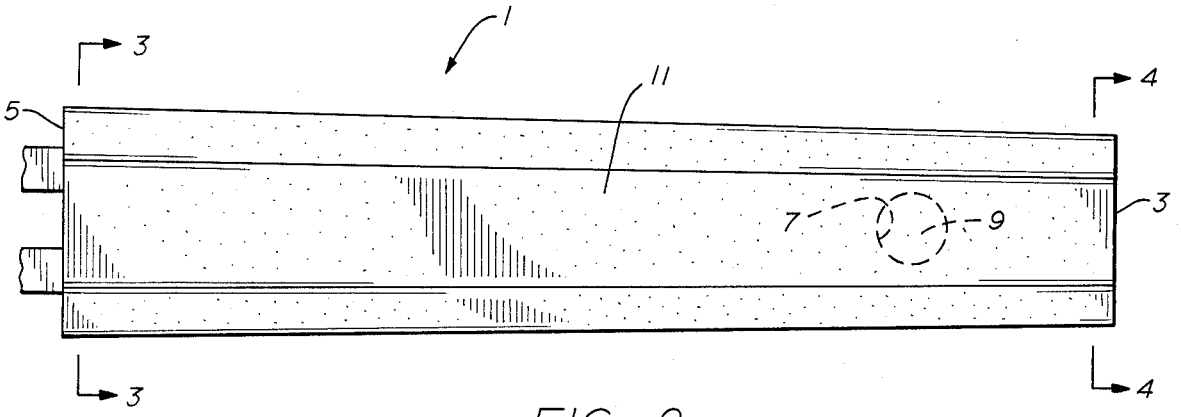
FIG. 2 is a plan view of the grip of the present invention.
Figure 3:
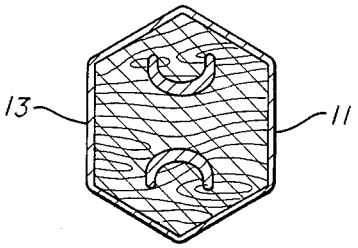
FIG. 3 is a sectional view taken along line 3—3.
Figure 4:
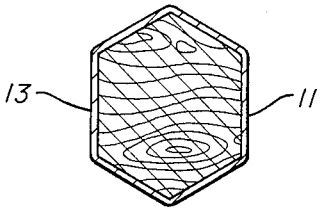
FIG. 4 is a sectional view taken along line 4—4.

Turning first to FIG. 1, there is shown a tennis racket having the modified grip 1 of the present invention. The modified grip 1 has a proximal end 3 and a distal end 5. Both the proximal end 3 and the distal end 5 are hexagonally shaped as is the grip 1 throughout its length. The grip 1 is tapered such that the largest hexagonal cross-section is located at the distal end 5 and the smallest hexagonal cross-section is located at the proximal end 3.

A bore 7 is provided in grip 1 originating near the proximal end 3. Bore 7 provides residence for the insertion of a weight 9 therein. The purpose of weight 9 is to maintain the proper center of gravity of the tennis racket which is significantly effected by the tapering of the grip as opposed to the conventional flaring or widening of the grip.

Holding the grip 1 of the present invention or a tennis racket having a conventional grip properly is dependent upon a number of structural characteristics of the human hand, wrist and arm. For example, the wrist must be mobile, the fingers must have normal flexibility and the thumb must be in opposition. When holding a tennis racket, as the thumb opposes, the thenar or fleshy emminence at the base of the thumb serves as a buttress against which the flexing fingers press the handle of the racket. While the fingers flex about the grip of the racket, they must also ulnar deviate thus allowing the tips of the fingers to point in the direction of the thenar emminence.

It should also be understood that for the fingers and thumb flexors to work most efficiently, the wrist must go into dorsi flexion of approximately 20 degrees meaning that the wrist must be slightly cocked in the direction toward the back of the hand. If the wrist is in a neutral position or in volar flexion, meaning that it is rotated in the direction of the palm of the hand, the muscles which control extension of the fingers, called extensors, are stretched. This stretching of the extensors conflicts with the opposing flexors to the point that the flexors cannot pull the fingers into the full flexion arc.

The flexor tendons approach the metacarpophalangeal joints, the joints at which the bones of the hand meet the bones of the fingers, at a slight ulnar angle.

When the wrist is radial deviated (cocked in the direction of the radius), such action causes a more direct approach of the tendons to the fingers and consequently allows a more forceful pull by the flexors.

The metacarpals of the ring and little finger have mobility and if they are allowed to oppose and flex toward the thenar emminence, the ring and little fingers can flex more securely about the grip 1. This flexing of the ring and little finger metacarpals allows the ring and little fingers to grasp the racket in what can be termed as a hooked grip which is the least fatiguing of all grips.

The grip activities of the bones, muscles and tendons described above is optimized by the grip of the present invention. Conventional racket grip design is contrary to these muscle activities and may create circumstances which can be stressful and damaging to some of the muscles of the forearm.

Conventional tennis racket grips are octagonal in cross-section. They are tapered such that the cross-sectional area at the base of the handle is the largest cross-section of the grip and that portion of the grip closest to the head of the racket is the smallest in cross-sectional area. This design causes the ring and little fingers to hold a portion of the grip which is dimensionally larger than that portion being held by the thumb and index finger. Further, the octagonal shape of conventional tennis racket grips not conform to the points of contact presented by the palmar surface of the distal, middle and proximal phalanges of the index finger as well as the palmar surface of the metacarpals of the thumb and index finger. The design of the present invention, being hexagonal in shape, is much more conducive to proper palmar contact of these surfaces with the grip 1. It should be noted that the grip 1 although hexagonal in shape has two opposing surfaces which are dimensionally larger then the other four. These opposing and larger surfaces 11 and 13 can be described as those surfaces which are closest to being parallel with the plane of the tennis racket strings 15. These larger surfaces furnish proper contact points for the proximal and distal phalanges of the fingers and the distal phalanx of thumb which can comfortably conform to this hexagonal configuration. The hexagonal cross-section is characterized by a plurality of opposing vertices in which two of the opposing vertices lie in a plane that is coplanar with the plane of said head, see FIG. 1.

The taper of the present invention is inverse to the taper of the conventional tennis racket grip. This reverse taper allows the wrist to comfortably and automatically go into dorsi flexion with no particular effort. This automatic dorsi flexion of the wrist has been measured in one hundred randomly selected individuals, fifty of each sex. It was found that there is an average of ten degrees difference in dorsi flexion between holding a conventional tennis racket grip and the grip of the present invention. This dorsi flexion of the wrist also allows the wrist to go into slight radial deviation. The net result of a wrist which is in dorsi flexion as well as slight radial deviation is the allowance of the fingers to flex more comfortably with less fatigue. The dorsi flexed position of the wrist causes the wrist extensor muscles to be more relaxed. In this relaxed position, the muscles are at their normal or resting length which situates the extensors in the optimum position for maximum contractile strength.

A conventional tennis racket grip creates a much less advantageous situation. The player using the conventional grip must contract the wrist extensor muscles in order to purposely cock the wrist prior to hitting serves, overhead slams and backhands. As the player brings the racket through the ball, he is applying a force which is in direct opposition to the contracted extensor muscles. This can result in small tears in the muscle origin and such injury is typically referred to as tennis elbow.

Thus, it can be seen that the inverse taper of the present invention allows for more comfortable gripping by providing ease of finger flexion which is the proximate result of allowing the wrist to automatically go into dorsi flexion. The inverse taper and hexagonal cross-section further allow for the mobile ring and little finger metacarpals to oppose the thenar emminence at the narrower portion of the grip thus bringing the ring and little fingers into more advantageous contact as well as creating more contact with the palmar surfaces of the index finger and the metacarpals of the thumb and the index finger. This results in a less fatiguing hook grip effect previously described. Thus, the greatest part of the grip force is transfered to the ring and little fingers allowing the thumb and index finger to be in a more appropriate alignment to effect racket control.

From the foregoing, it wil be seen that this invention is one well adapted to attain all of the ends and objects hereinabove set forth, together with other advantages which are obvious and which are inherent to the device.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An improved racket comprising:

(a) a substantially planar head;

(b) an elongate handle extending from said substantially planar head and having a longitudinal axis which resides in the plane of said head, said longitudinal axis bisecting symmetrically said head when extended therethrough;

(c) a grip having one end attached to said handle and having a free end, said grip having a longitudinal axis which is colinear with said longitudinal axis of said handle, said grip further having hexagonal cross-sections when viewed in planes perpendicular to the longitudinal axis thereof, the cross-sections of said grip decreasing in area from a point proximate said handle to a point proximate said free end so as to define a tapering configuration;

(d) each of said hexagonal cross-sections further being characterized by a plurality of opposing vertices, two of said opposing vertices lying in a plane that is coplanar with the plane of the head of the racket so as to thereby provide a racket with a grip that is structurally compatible with the human hand.

2. A tennis racket comprising:

(a) a head lying in a plane;

(b) an elongate handle extending from said head and having a longitudinal axis extending therethrough and through the plane of the head;

(c) a grip having a first end affixed to said elongate handle and a second end remote therefrom, said grip being characterized by a longitudinal axis extending through each said first and second ends and also by a hexagonal cross-section when viewed in planes perpendicular to said longitudinal axis, each of said hexagonal cross-sections being smaller than the preceding hexagonal cross-section when moving from the first end toward said second end, thereby defining a tapered grip;

(d) said tapered hexagonal grip being further characterized in cross-section by a plurality of opposing vertices, two of said opposing vertices lying in a plane which is coplanar with the plane of said head so as to thereby provide a racket with a grip orthopedically compatible with the human hand.

3. A racket comprising:

(a) a head residing in a plane;

(b) a tapered grip extending from said head and having a longitudinal axis which lies in said plane of said head and which is characterized by a hexagonal cross-section when viewed in a plane perpendicular to the longitudinal axis, said tapered grip including a free end remote the end extending from said head and in which the smallest hexagonal cross-section resides proximate said free end;

(c) said hexagonal cross-section being characterized by a plurality of opposing vertices in which two of said opposing vertices lie in a plane that is coplanar with the plane of said head.

4. In a racket having a head residing in a plane which is characterized by an axis bisecting the head, the improvement comprising:

a grip extending from the head and having a free end, said grip further including a longitudinal axis which is colinear with the axis bisecting the head, said grip being hexagonal in cross-sections perpendicular to the longitudinal axis, the cross-sectional area of said grip decreasing from a point proximate the head to a point proximate the free end so as to define a tapering configuration, the hexagonal cross-section being characterized by a plurality of opposing vertices in which two of said opposing vertices lie in a plane that is coplanar with the plane of the head of the racket.

5. In a racket having a substantially planar head portion which is characterized by a bisecting axis lying in the plane thereof and by an elongate handle affixed thereto, the improvement comprising:

a tapered body having a first end and a second free end, said first end being affixed to the elongate handle, said tapered body being characterized by a longitudinal axis parallel to and coincident with the bisecting axis of the head, and further being characterized by a hexagonal cross-section substantially throughout its length when viewed in planes perpendicular to said longitudinal axis, said tapered body being larger in cross-sectional area at the fixed end and smaller in cross-sectional area at the free end and tapering in cross-sectional area between the fixed and free end, the hexagonal cross-section including a plurality of opposing vertices in which a line between two of said opposing vertices lies in a plane that is substantially coplanar with the plane of the head.

* * * * *